US008534494B2

(12) United States Patent
Black, Jr. et al.

(10) Patent No.: US 8,534,494 B2
(45) Date of Patent: Sep. 17, 2013

(54) PRODUCT DETECTION SYSTEM FOR A VENDING MACHINE

(75) Inventors: Talbert James Black, Jr., Lexington, SC (US); Thomas Roger Meinardi, Aiken, SC (US)

(73) Assignee: Crane Merchandising Systems, Inc., Bridgeton, MO (US)

( * ) Notice: Subject to any disclaimer, the term of this patent is extended or adjusted under 35 U.S.C. 154(b) by 1313 days.

(21) Appl. No.: 11/586,495

(22) Filed: Oct. 26, 2006

(65) Prior Publication Data

US 2008/0099496 A1 May 1, 2008

(51) Int. Cl.
*G07F 11/10* (2006.01)
*B65H 5/00* (2006.01)

(52) U.S. Cl.
USPC ..... 221/133; 221/126; 221/129; 221/130; 221/131; 221/2; 221/13; 221/258; 221/224

(58) Field of Classification Search
USPC ..... 221/1–312 C; 700/231–244
See application file for complete search history.

(56) References Cited

U.S. PATENT DOCUMENTS

| | | | | |
|---|---|---|---|---|
| 4,030,632 | A | 6/1977 | Harashima | |
| 4,560,088 | A * | 12/1985 | Tan | 221/75 |
| 4,812,629 | A | 3/1989 | O'Neil et al. | |
| 5,791,512 | A | 8/1998 | Kanatsuka | |
| 6,199,720 | B1 | 3/2001 | Rudick et al. | |
| 6,230,930 | B1 | 5/2001 | Sorensen et al. | |
| 6,328,180 | B1 * | 12/2001 | Sorensen et al. | 221/131 |
| 6,349,244 | B1 | 2/2002 | Bardin et al. | |
| 6,415,950 | B1 * | 7/2002 | Robrechts | 221/85 |
| 6,499,627 | B2 * | 12/2002 | Arai | 221/130 |
| 6,556,889 | B2 | 4/2003 | Rudick et al. | |
| 6,708,079 | B2 | 3/2004 | Mason, II | |
| 6,755,322 | B1 * | 6/2004 | Herzog et al. | 221/123 |
| 6,772,906 | B2 | 8/2004 | Wittern, Jr. et al. | |
| 6,794,634 | B2 | 9/2004 | Hair, III et al. | |
| 7,032,776 | B2 | 4/2006 | Hieb | |
| 7,073,683 | B1 * | 7/2006 | Quinnell et al. | 221/21 |
| 7,344,050 | B2 * | 3/2008 | Robrechts | 221/120 |
| 2005/0082309 | A1 | 4/2005 | Holdway et al. | |
| 2005/0189370 | A1 | 9/2005 | Carter et al. | |
| 2006/0261080 | A1 * | 11/2006 | Matsumoto et al. | 221/124 |

OTHER PUBLICATIONS

Canadian Office Action dated Feb. 5, 2013 in connection with Canadian Patent Application No. 2,567,862.

* cited by examiner

*Primary Examiner* — Michael K Collins

(57) ABSTRACT

A vending machine includes a product detection system for signaling a vending controller that a selected product has released from a product support shelf. The vending machine includes a product delivery device that, upon initiation of a vending operation, transports the selected product from the product support shelf towards a delivery area. Upon initiation of a vending operation, a motor moves a product delivery device to a position adjacent the selected product. A dispensing mechanism then releases the selected product which falls into the delivery device, imparting a downward force which is sensed at the motor. A sensor detects the downward force and signals the vending controller that the product has been received by the product delivery device. At this point, the vending controller continues with the vending operation.

20 Claims, 4 Drawing Sheets

PRODUCT DETECTION SYSTEM FOR A VENDING MACHINE

BACKGROUND OF THE INVENTION

1. Field of the Invention

The present invention pertains to the art of vending machines and, more particularly, to a system for detecting a transfer of a selected product from one of a plurality of shelves to a product delivery device through movement imparted to a motor operatively connected to the product delivery device.

2. Discussion of the Prior Art

Vending machines for dispensing canned and/or bottled beverages have long been known. Early model vending machines release similarly sized bottles, one at a time, following deposit of a required purchase amount. In order to withdraw the selected product from the vending machine, the purchaser was required to, for example, manually remove a beverage container through a release mechanism on a shelf. Over time, manufacturers developed various mechanisms for releasing products from vending machines. The mechanisms range from a more conventional arrangement wherein products are guided to a chute, often times along a serpentine path, into a delivery port, to a more unique arrangement that shifts a transport carrier to a point adjacent a selected product, receives the selected product and then delivers the selected product to the adjacent delivery port.

Unlike the more conventional arrangements where the release and delivery of a product is readily determined, in the more unique arrangements, often times one or more cycles must be completed if a product is not properly released. If the product does not transfer into the transport carrier, there is nothing to deliver to the consumer. If the vending machine fails to deliver a product, the consumer is either refunded the purchase amount or the vending machine will initiate another vending cycle and make a second attempt to deliver the selected product. In either case, the vending cycle must typically near completion before the vending machine determines that the product has been delivered to the consumer. The time required to make this determination may lead to consumer frustration.

In order to address this problem, manufacturers have employed various sensors to determine whether a product has been properly transferred to a transport carrier. In accordance with one such arrangement, a sensor, such as an optical beam, is positioned in the transport carrier. When the selected product is transferred into the transport carrier, the beam is interrupted or broken. When the beam is broken, a signal is sent to a control indicating that a product is present in the transport carrier. While effective, occasionally the product does not enter the cup properly and the beam remains unbroken. In this case, the vending machine attempts to deliver a second product into the transport carrier or, if the product is sold out, ceases the vend operation and refunds the purchase amount, leaving the customer without the desired product.

Thus, despite the existence of product detection systems in the prior art, there still exists a need for a system that detects the receipt of a selected product in a vending machine product delivery device. More specifically, there exists a need for a product detection system that can reliably detect the presence of a product at an initial stage of a vending operation.

SUMMARY OF THE INVENTION

The present invention is directed to a vending machine having a product detection system that senses whether a selected product has transferred from a product staging area or queue into a product transport system. The vending machine includes a cabinet and a plurality of product support shelves, each of which includes multiple dividers that establish a plurality of product queues. Upon receipt of a purchase amount and the selection of a desired product, the vending machine initiates a vending operation. A controller activates the product transport system which drives a motor that shifts a product delivery device to a position adjacent one of the plurality of product queues. The selected product is then released from the product queue into the product delivery device and transported to a product delivery portion of the vending machine.

In accordance with the invention, upon being released, the selected product is deposited or dropped into the product delivery cup. As the product is received, a downward force is imparted to the product delivery device. The downward force carries or transfers through the product transport system to the motor. A sensor, operatively associated with the motor, detects the force and signals the controller that the product has transferred into the product delivery device. Once the signal is received, the controller continues the vending operation. Preferably, the sensor is constituted by an optical encoder mounted to the motor. Movement of the optical encoder in the absence of a drive signal from the controller indicates that the product has successfully transferred into the product delivery device. In accordance with one aspect of the invention, the product detection system also includes a capacitive-type sensor positioned in the delivery device. The capacitive-type sensor also signals the controller that the product is resting in the product delivery device. In this manner, the capacitive-type sensor confirms the signal received from the optical encoder.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
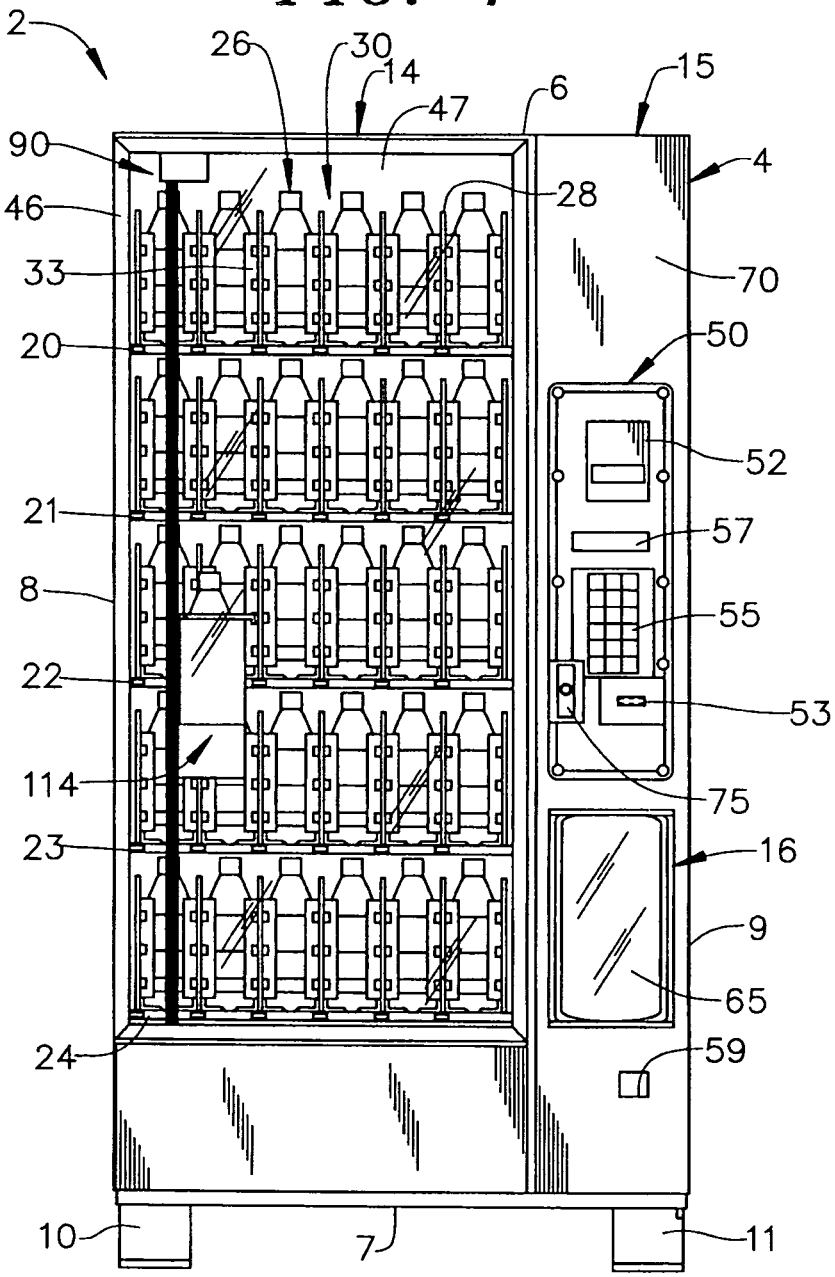
FIG. 1 is a front elevational view of a vending machine including a product detection system constructed in accordance with the present invention.
Figure 2:
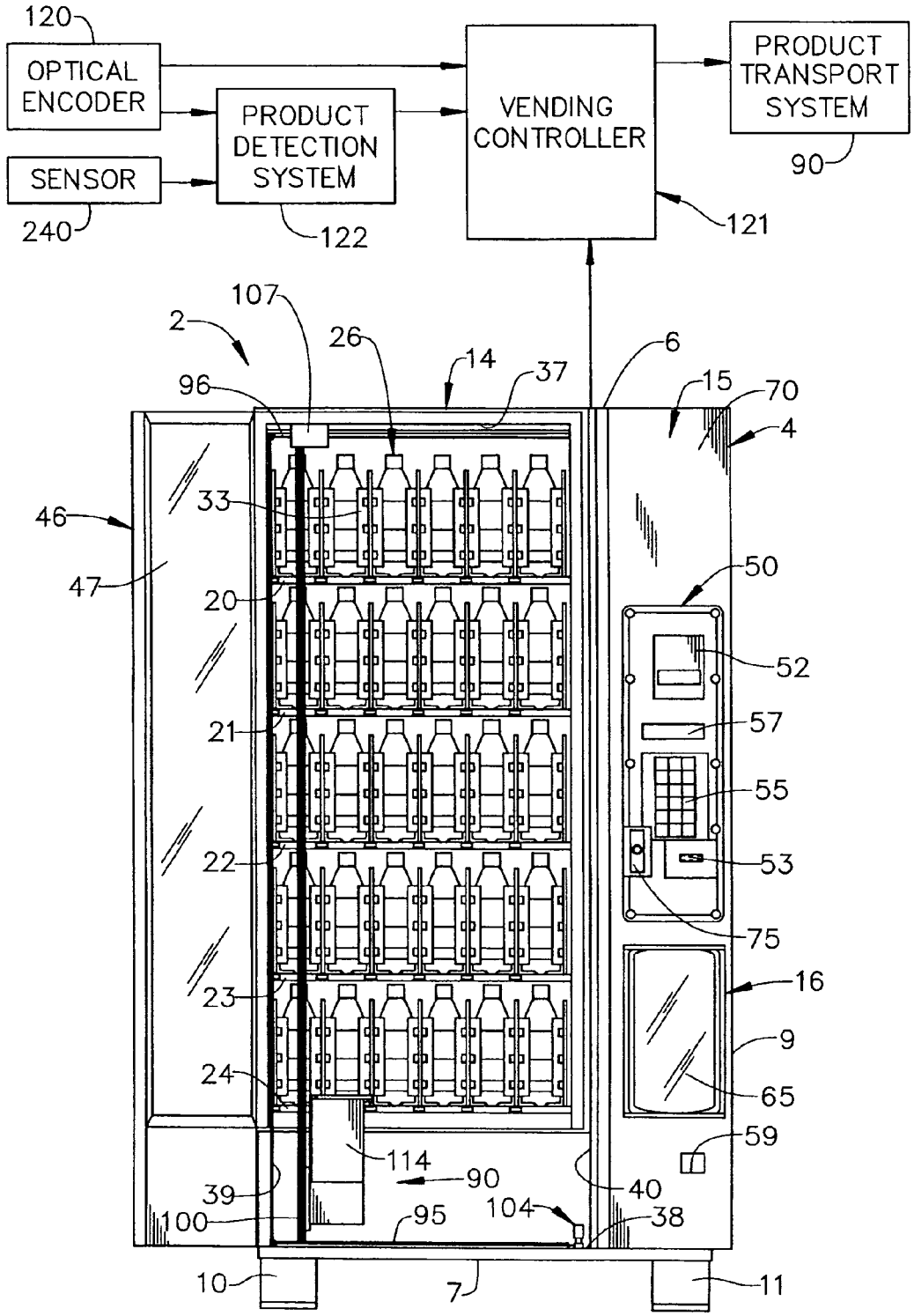
FIG. 2 is an elevational view of the vending machine of FIG. 1 with the door of a product storage zone shown open.

With initial reference to FIGS. 1 and 2, a vending machine generally indicated at 2 includes a cabinet 4. As shown, cabinet 4 includes top, bottom and opposing side walls 6-9. Arranged below bottom wall 7 are various leg members 10 and 11 for positioning vending machine 2 upon a supporting surface (not shown). In the preferred embodiment shown, vending machine 2 is divided into a plurality of zones, with each zone being associated with a particular portion of a vending operation. Towards that end, vending machine 2 includes a storage and display zone 14, a currency receiving zone 15 and a dispensing zone 16.

As illustrated, storage/display zone 14 is provided with a plurality of product support shelves 20-24 for supporting and displaying a plurality of product containers, one of which is indicated at 26. Each of the plurality of product support shelves 20-24 includes a plurality of dividers, one of which is indicated at 28, that establish a plurality of product queues, one of which is indicated at 30, on product support shelf 20. Each of the plurality of product queues 30 includes an associated dispensing or escapement mechanism 33 that is selectively operated to release a product container 26 from storage/display zone 14 for delivery to a consumer. However, the actual construction and operation of dispensing mechanism 33 does not constitute part of the present invention. Instead, various known dispensing mechanisms could be employed, including that set forth in detail in commonly assigned U.S. Pat. No. 6,571,988 entitled "Article Release Mechanism For a Vending Machine" issued on Jun. 3, 2003 which is incorporated herein by reference. In a manner known in the art, storage/display zone 14 includes top, bottom and opposing side walls 37-40 and is provided with a door 46 having a glass panel 47 that enables a consumer to view and choose between the variety of product containers 26 available for purchase located within vending machine 2.

Arranged alongside storage/display zone 14 is currency receiving zone 15. In the embodiment shown, currency receiving zone 15 includes a currency receiving center 50 for inputting a required purchase price to initiate currency during a vend transaction or operation. Currency receiving center 50 includes a bill acceptor/validator 52, a multi-price coin mechanism 53 and a keypad 55 for inputting particular product selections. Currency receiving center 50 also includes a display 57 for providing information to the consumer, as well as validating the particular selection made. Finally, a coin return slot 59 is provided for returning any required change to the consumer at the completion of the vend operation. Arranged below currency receiving zone 15, dispensing zone 16 includes a delivery port 65 that enables a consumer to retrieve a dispensed product from vending machine 2. In the embodiment shown, currency receiving zone 15 and dispensing zone 16 are provided on a door 70 that overlaps door 46 and therefore must be opened prior to opening door 46. To this end, door 70 is preferably provided with a lock 75 that prevents unauthorized access to vending machine 2.

In the embodiment shown, vending machine 2 includes a product transport system 90 that receives a selected one of the plurality of product containers 26 from one of the plurality of product queues 30. Once the selected product is received, transport system 90 carries the selected product towards delivery chamber 65. As referenced in FIG. 2, product transport system 90 includes a first, laterally extending guide rail 95 arranged on lower wall 38 of product storage zone 14, a second, laterally extending guide rail 96 arranged on upper wall 37 and an upstanding carriage rail 100 that extends across storage/delivery zone 14 between first and second guide rails 95 and 96. Product transport system 90 also includes a first motor or horizontal axis translation mechanism 104 for shifting carriage rail 100 between the plurality of product queues 30 and a second motor or vertical axis translation mechanism 107 coupled to a drive belt (not labeled) that selectively shifts a product delivery device, preferably in the form of a delivery cup 114 slidably supported by carriage rail 100, between the plurality of product shelves 20-24. Although various product transport systems can actually be employed in the present invention, details of the preferred product transport system 90 can be found in commonly assigned pending U.S. patent application Ser. No. 11/249,526 entitled "Product Transport System For a Vending Machine" filed on Oct. 14, 2005 incorporated herein by reference.

As will be discussed more fully below, second motor 107 has associated therewith an optical encoder 120 that, in addition to providing feedback to a vending controller 121 regarding a particular position of product delivery cup 114, is coupled to a product detection system 122 to signal vending controller 121 that a product has passed from one of the plurality of product queues 30 into product delivery cup 114. While shown as a separate component, product detection system 122 is preferably incorporated into vending controller 121. In any event, optical encoder 120 is operatively associated with motor 107, preferably associated with an output shaft (not shown) of motor 107. Optical encoder 120 senses rotation of motor 107 and provides position signals to vending controller 121 to determine when product delivery cup 114 is properly positioned at the particular product queue 30 containing the selected product. As will be discussed more fully below, once product delivery cup 114 is positioned at product queue 30, vending controller 121 should not receive any signals from optical encoder 120 until product delivery cup 114 is moved towards dispensing zone 16.

Figure 3:
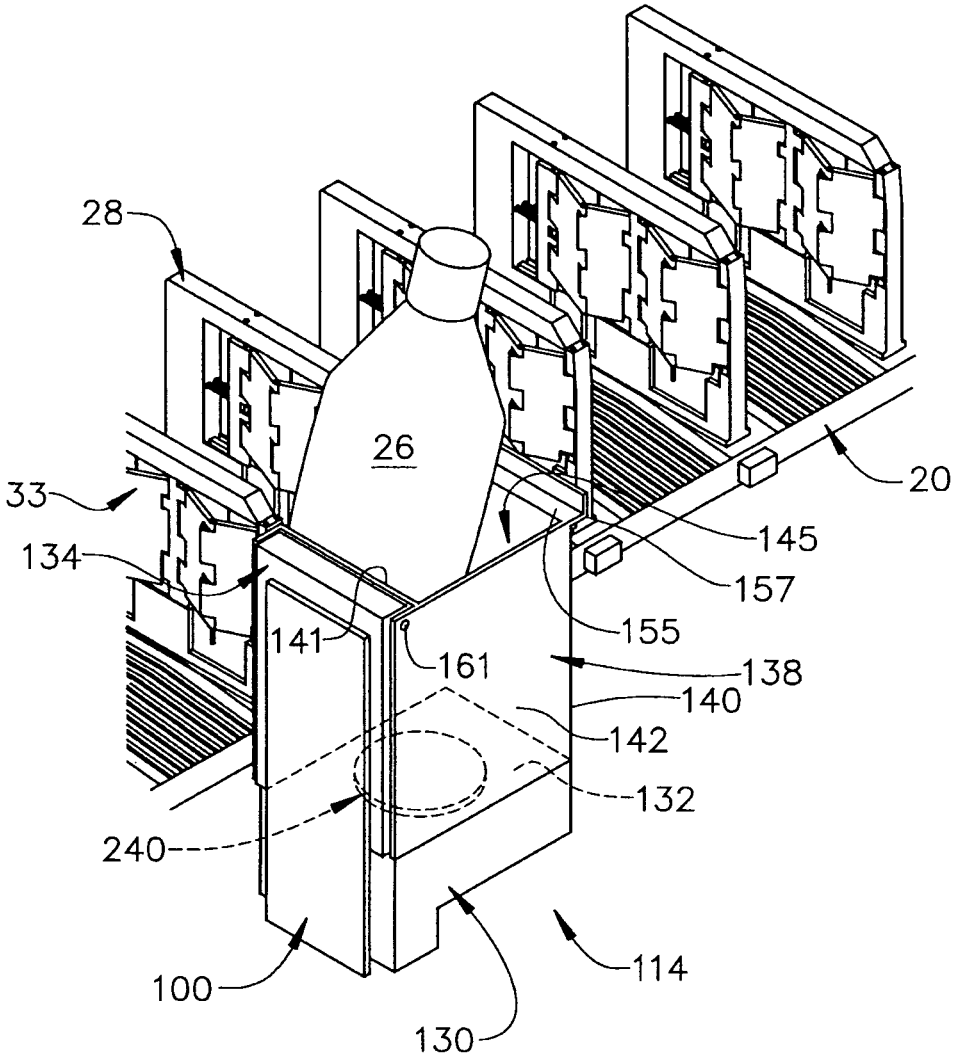
FIG. 3 is a partial, perspective view of a product being released into a product delivery device.
Figure 4:
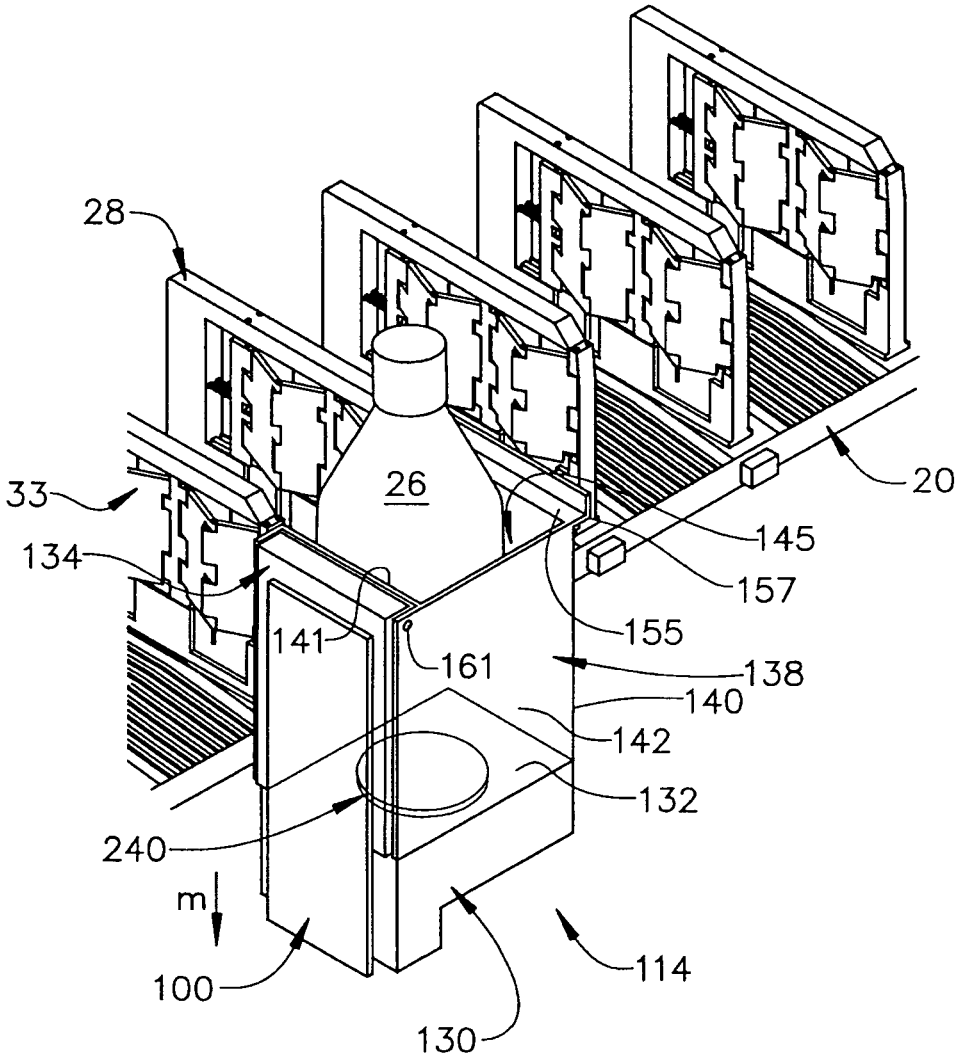
FIG. 4 is a partial, perspective view of the product resting in the product delivery device after having triggered the product detection system.

Reference will now be made to FIGS. 3-4 in describing particulars of product delivery cup 114. As shown, product delivery cup 114 includes a base portion 130 having a product support surface 132, a carriage portion 134 that is shiftably mounted to carriage rail 100 through a drive belt (not shown), and a shroud portion 138 pivotally mounted to carriage portion 134. Shroud portion 138 includes side walls 140 and 141 and a front wall 142 that collectively define a product receiving cavity 145. It should be noted that shroud portion 138 also includes a rear wall (not shown), that is lower than front wall 142, thereby enabling a product container 26 to be transferred into product delivery cup 114. In any case, shroud portion 138 includes a laterally outwardly projecting extension or discharge element 155 having an up-turned portion 157 provided at an upper portion (not separately labeled) of side wall 140. Discharge element 155 engages with structure (not shown) provided on side wall 40, causing shroud portion 138 to pivot about an axis defined by a pin 161 to discharge product container 26 into delivery port 65. However, as discharging or releasing product container 26 from product delivery cup 114 does not fall within the scope of the present invention, these details will not be discussed more fully herein. Instead, the details of releasing product container 26 into delivery chamber 65 can be found in commonly assigned pending U.S. patent application Ser. No. 11/249,527, entitled "Product Discharge and Delivery System For a Vending Machine" filed Oct. 14, 2005 incorporated herein by reference.

In accordance with the invention, at the start of the vending operation, product transport system 90 shifts product delivery cup 114 to a position adjacent one of the plurality of product queues 30 within which resides the selected product container 26. At this point, dispensing mechanism 33 is activated to release the selected product container 26 into product receiving cavity 145. As the selected product impacts product support surface 132, a force "m" is imparted to motor 107 through the drive belt (not shown) resulting in an unexpected movement of optical encoder 120. That is, as discussed above, once product delivery cup 114 is properly positioned at product queue 30, there should be no movement of motor 107 detected by optical encoder 120 until vending controller 121 signals product transport system 90 to shift delivery cup 114 toward dispensing zone 16. Thus, any movement sensed by optical encoder 120 prior to the signal sent from vending controller 121 to shift product delivery cup 114 towards dispensing zone 16 is unexpected. Any unexpected movement of motor 107 that occurs after product delivery cup 114 is properly positioned and prior to being operated to shift the selected product toward dispensing zone 16 is detected by optical encoder 120 and passed to product detection system 122. The unexpected movement signals product detection system 122 that product container 26 has properly transferred into product delivery cup 114.

In accordance with one aspect of the invention, after dispensing mechanism 33 is operated to release product container 26 into product receiving cavity 145, product delivery cup 114 is shifted towards dispensing zone 16 and product container 26 released into delivery port 65. A sensor (not shown) in delivery port 65 confirms receipt of product container 26. If no confirmation signal is received, the signal from product detection system 122 indicating that a product failed to dispensed is confirmed and either a new vending cycle is attempted or the consumer is refunded the purchase price. In accordance with another aspect of the invention, product detection system 122 includes a redundancy system in the form of a capacitive-type sensor 240 located in base portion 130. That is, capacitive-type sensor 240 also detects a presence of product container 26 on product support surface 132 and signals product detection system 122, confirming the signal passed from optical encoder 120. In this manner, the presence of product container 26 in product delivery cup 114 is confirmed prior to attempting to complete the vend cycle.

With this arrangement, vending controller 122 is assured that the selected product container 26 resides in product receiving cavity 145 before continuing with the vending operation. In the event that no signal is received from product detection system 122, vending controller 121 can either shift product delivery cup 114 to an adjacent product queue holding a similar product or, if no other identical products are available, enable an alternate selection or simply refund the purchase amount to the consumer. In any case, once the selected product container 26 has been received in product delivery cup 114, product transport vending controller 121 signals product transport system 90 to shift product delivery cup 114 towards a portal (not shown) which is formed in side wall 40 of product storage and display zone 14. Once in position, the selected product is released into delivery port 65.

Although described with reference to a preferred embodiment of the invention, it should be readily understood that various changes and/or modifications can be made to the invention without departing from the spirit thereof. For instance, while described as employing an optical encoder to sense the unexpected movement of the motor, changes in holding current that maintains the product delivery cup adjacent the product queue can also be employed. Also, while sensor 140 is described as a capacitive-type sensor, other types of sensors can also be utilized to sense the presence of the selected product. Finally, while the product delivery device is shown and described as a product delivery cup, other devices, including a conveyor belt, could also be employed. In general, the invention is only intended to be limited by the scope of the following claims.

We claim:

1. A vending machine comprising:

a cabinet;

a plurality of product support shelves arranged in the cabinet, each of said plurality of product support shelves includes a plurality of dividers that establish multiple product queues on each of the plurality of shelves;

a product dispensing zone provided in the cabinet, said product dispensing zone providing access to a selected product container following a vending operation;

a door pivotally mounted to the cabinet for selectively providing access to the plurality of product support shelves;

a product transport system provided in the cabinet, said product transport system including a product delivery device for selectively delivering a selected product container from one of the plurality of product queues toward the product dispensing zone;

a motor operatively connected to the product delivery device, said motor selectively positioning the product delivery device adjacent one of the plurality of product queues; and a product detection system operatively connected to the motor, said product detection system sensing a presence of a selected product at the product delivery device through movement of the motor resulting from the selected product being transferred from the one of the plurality of product queues.

2. The vending machine according to claim 1, wherein product detection system includes an optical encoder operatively connected to the motor.

3. The vending machine according to claim 2, wherein the presence of the selected product in the product delivery device is detected based upon an unexpected movement of the product delivery device sensed at the motor.

4. The vending machine according to claim 1, further comprising: a redundant system confirming that the product has transferred into the product delivery device.

5. The vending machine according to claim 4, wherein the redundant system includes a capacitive-type sensor mounted in the product delivery device, said capacitive sensor signaling a presence of a product in the product delivery device.

6. The vending machine according to claim 5, wherein the capacitive-type sensor extends along a bottom wall of the product delivery device.

7. The vending machine according to claim 1, further comprising: a drive belt operatively connecting the motor and the product delivery device, said drive belt transmitting movement from the product delivery device to the motor when the selected product is received in the product delivery device.

8. A vending machine comprising:

a cabinet;

a plurality of product support shelves arranged in the cabinet, each of said plurality of product support shelves includes a plurality of dividers that establish multiple product queues on each of the plurality of shelves;

a product delivery portion provided in the cabinet, said product delivery portion providing access to a selected product container following a vending operation;

a door pivotally mounted to the cabinet for selectively providing access to the plurality of product support shelves;

a product transport system provided in the cabinet, said product transport system including a product delivery device for selectively delivering a selected product container from one of the plurality of product queues toward the product delivery portion;

a motor operatively connected to the product delivery device, said motor selectively positioning the product delivery device adjacent one of the plurality of product queues; and means for detecting a presence of a selected product in the product delivery device through sensed movement of the motor resulting from the selected product being transferred from the one of the plurality of product queues.

9. The vending machine according to claim 8, wherein the detecting means includes an optical encoder operatively connected to the motor.

10. The vending machine according to claim 8, wherein the detecting means senses the presence of the selected product in the product delivery device based upon an unexpected movement of the product delivery device sensed at the motor by the optical encoder.

11. The vending machine according to claim 8, further comprising: means for confirming that the product has transferred into the product delivery device.

12. The vending machine according to claim 11, wherein the confirming means includes a capacitive-type sensor mounted in the product delivery device, said capacitive sensor signaling a presence of a product in the product delivery device.

13. The vending machine according to claim 12, wherein the capacitive-type sensor is mounted in a bottom wall of the product delivery device.

14. The vending machine according to claim 8, further comprising: a drive belt operatively connecting the motor and the product delivery device, said drive belt transmitting movement from the product delivery device to the motor when the selected product is received in the product delivery device.

15. A method of detecting a product transfer from a product queue onto a product delivery device provided in a vending machine comprising:

selecting a product to initiate a vending operation;

activating a motor to shift a product delivery device to a position adjacent a product queue containing the selected product;

releasing the selected product from the product queue onto the product delivery device; and sensing a movement of the motor resulting from the selected product being released onto the product delivery device to indicate that the selected product has been properly transferred into the product delivery device.

16. The method of claim 15, wherein the presence of the product in the product delivery device is determined by an unexpected movement of the motor.

17. The method of claim 16, further comprising: sensing the unexpected movement of the motor with an optical encoder operatively connected to the motor.

18. The method of claim 15, further comprising: confirming that the selected product has been properly transferred into the product delivery device through a redundant system.

19. The method of claim 18, wherein the proper transfer of the selected product is confirmed by a capacitive-type sensor mounted to the product delivery device.

20. The method of claim 15, wherein the movement of the motor resulting from the selected product being released into the product delivery device is transferred from the product delivery device to the motor through a drive belt.

* * * * *